US011286109B2

(12) United States Patent
Shek

(10) Patent No.: US 11,286,109 B2
(45) Date of Patent: Mar. 29, 2022

(54) GARBAGE BIN

(71) Applicant: Michael Shek, San Mateo, CA (US)

(72) Inventor: Michael Shek, San Mateo, CA (US)

( * ) Notice: Subject to any disclaimer, the term of this patent is extended or adjusted under 35 U.S.C. 154(b) by 29 days.

(21) Appl. No.: 16/805,026

(22) Filed: Feb. 28, 2020

(65) Prior Publication Data

US 2021/0269236 A1 Sep. 2, 2021

(51) Int. Cl.
*B65D 51/04* (2006.01)
*B65F 1/16* (2006.01)

(52) U.S. Cl.
CPC ..... *B65F 1/1607* (2013.01)

(58) Field of Classification Search
CPC ..... B65F 1/16; B65F 1/1607; B65F 2210/129
USPC ..... 220/254.1, 908, 908.2, 254.3, 263, 220/495.06, 495.08, 810
See application file for complete search history.

(56) References Cited

U.S. PATENT DOCUMENTS

2011/0049149 A1* 3/2011 Shih ..... B65F 1/1607 220/260
2016/0001973 A1* 1/2016 Castro ..... B65B 67/1266 220/571

FOREIGN PATENT DOCUMENTS

EP 1035042 * 9/2000 ..... B65F 1/06

* cited by examiner

*Primary Examiner* — Don M Anderson
*Assistant Examiner* — Elizabeth J Volz
(74) *Attorney, Agent, or Firm* — Muncy, Geissler, Olds & Lowe, P.C.

(57) ABSTRACT

A garbage bin includes a bin body, a first frame, a second frame, and a lid body. The bin body has an opening and an internal space. The first frame is disposed on the bin body and includes a first engaging unit. The first frame encloses a first opening communicating the opening of the bin body. The second frame includes a second engaging unit and encloses a second opening. The second frame is detachably connected to the first frame by an engagement of the first engaging unit and the second engaging unit and communicates the first opening. Each of a direction of the second opening and a direction of the first opening is the same with the direction of the opening of the bin body. The lid body is pivotally connected to the second frame to selectively cover the second opening.

9 Claims, 10 Drawing Sheets

GARBAGE BIN

BACKGROUND OF THE INVENTION

Field of the Invention

The present invention relates to a garbage bin.

Description of the Prior Art

Conventional garbage bins includes lid-type and open-type. The open-type garbage bin is convenient to use, and the user can keep his hands clean because he doesn't have to touch the lid. On the other hand, the lid-type garbage bin is able to make the garbage isolated from exterior.

However, the conventional lid-type garbage bin has a pivot mechanism to make the lid pivotable. Thus, the lid cannot be used on other garbage bins without lids. Therefore, the garbage bin may be unfunctional when it's moved to other places, so the user has to buy another garbage bin.

SUMMARY OF THE INVENTION

The main object of the present invention is to provide a garbage bin having a lid which is changeable to meet user's need.

To achieve the above and other objects, the garbage bin of the present invention includes a bin body, a first frame, a second frame, and a lid body.

The bin body has an opening and an internal space. The first frame is disposed on the bin body and includes a first engaging unit. The first frame encloses a first opening. The first opening communicates the opening of the bin body. A direction along which the first opening is formed is the same with a direction along which the opening of the bin body is formed. The second frame includes a second engaging unit and encloses a second opening. The second frame is detachably connected to the first frame by an engagement of the first engaging unit and the second engaging unit. The second opening communicates the first opening. A direction along which the second opening is formed is the same with the direction along which the opening of the bin body is formed. The lid body is pivotally connected to the second frame to selectively cover at least part of the second opening.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
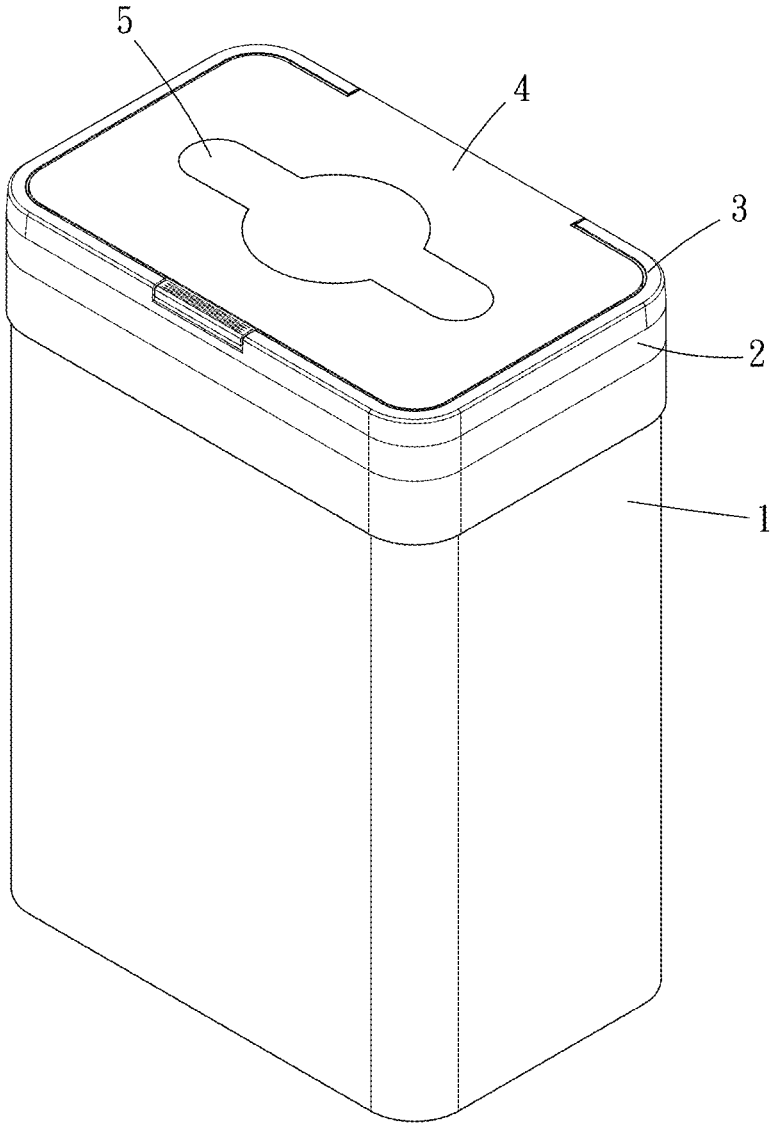
FIG. 1 is a stereogram of the present invention.
Figure 2:
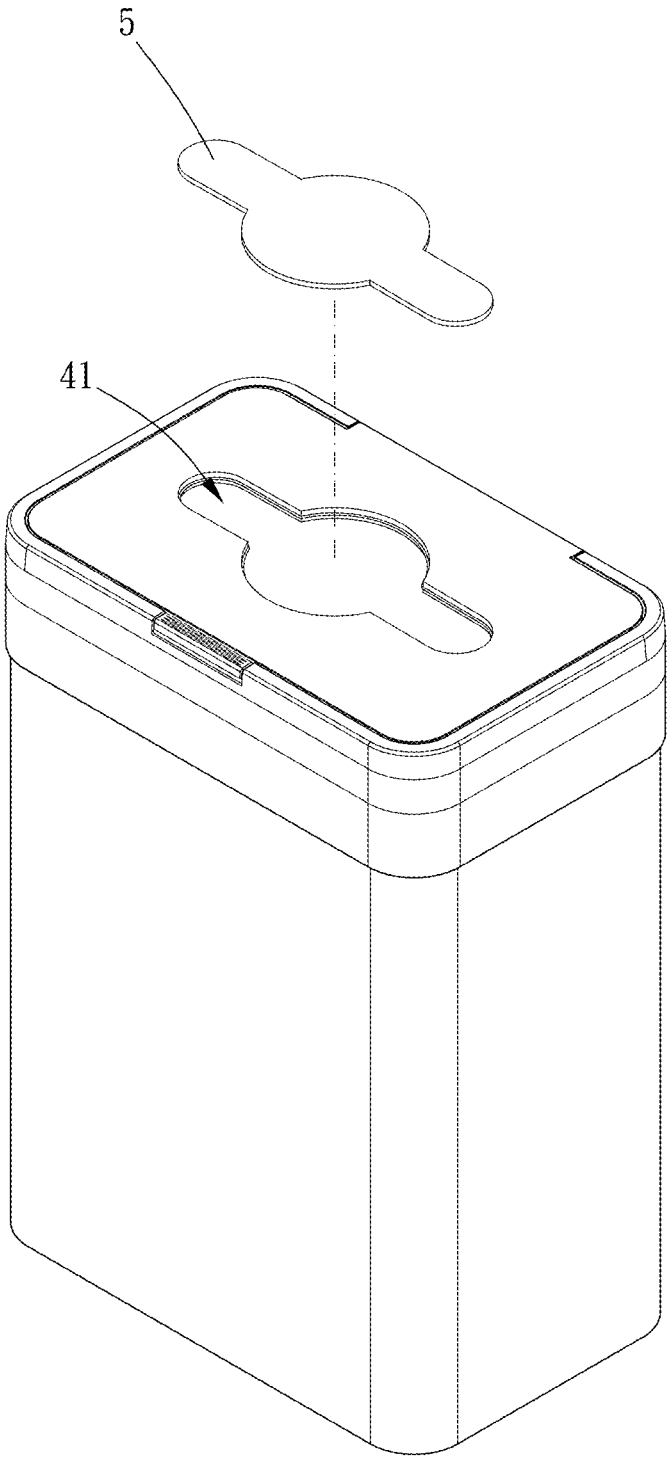
FIG. 2 is a breakdown drawing showing a covering plate and a lid body of the present invention.
Figure 3:
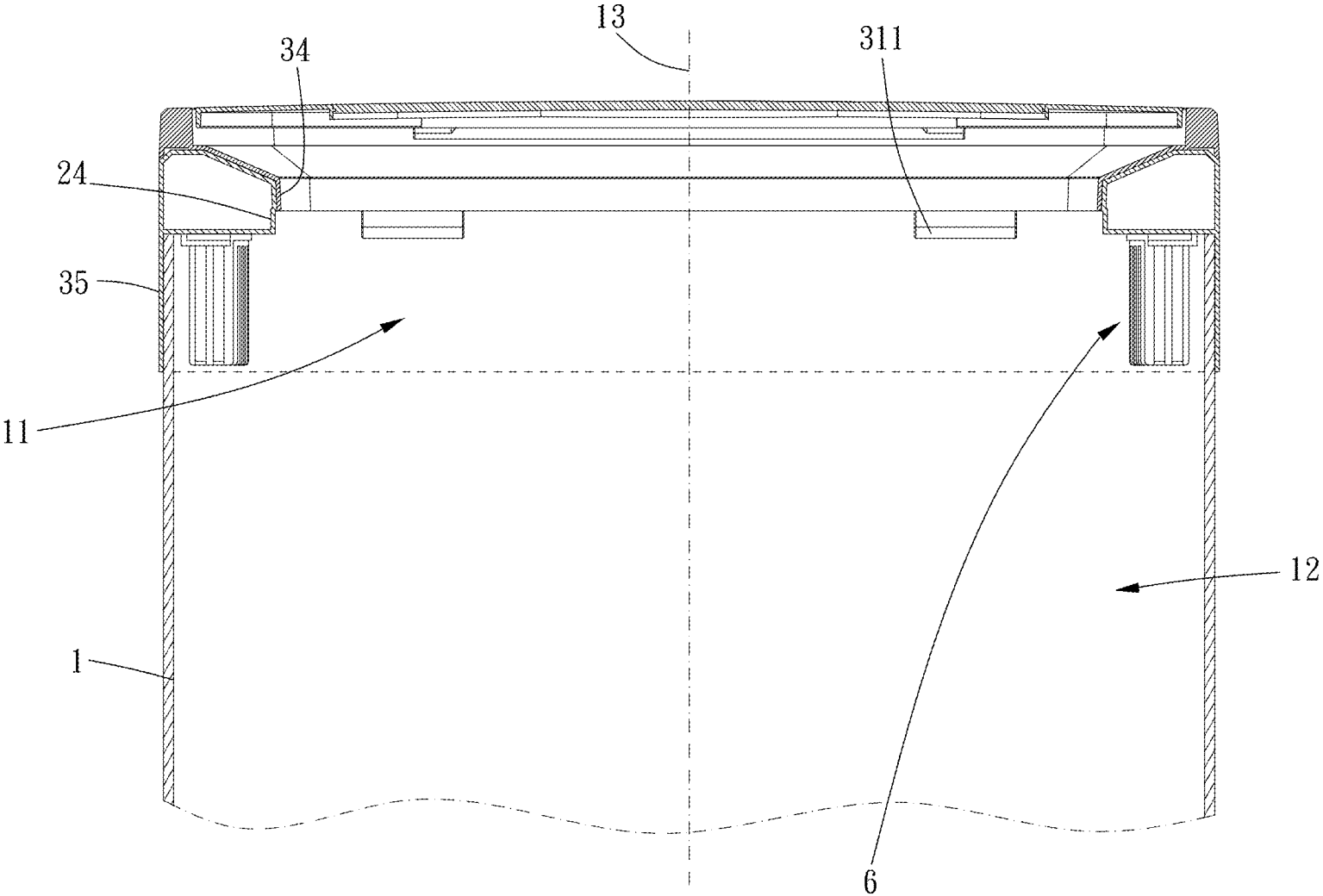
FIG. 3 is a front cross-section of the present invention.
Figure 5:
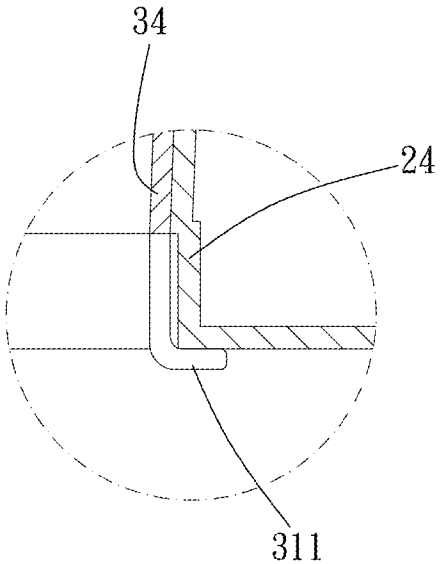
FIG. 5 is a partial enlargement of FIG. 4.
Figure 4:
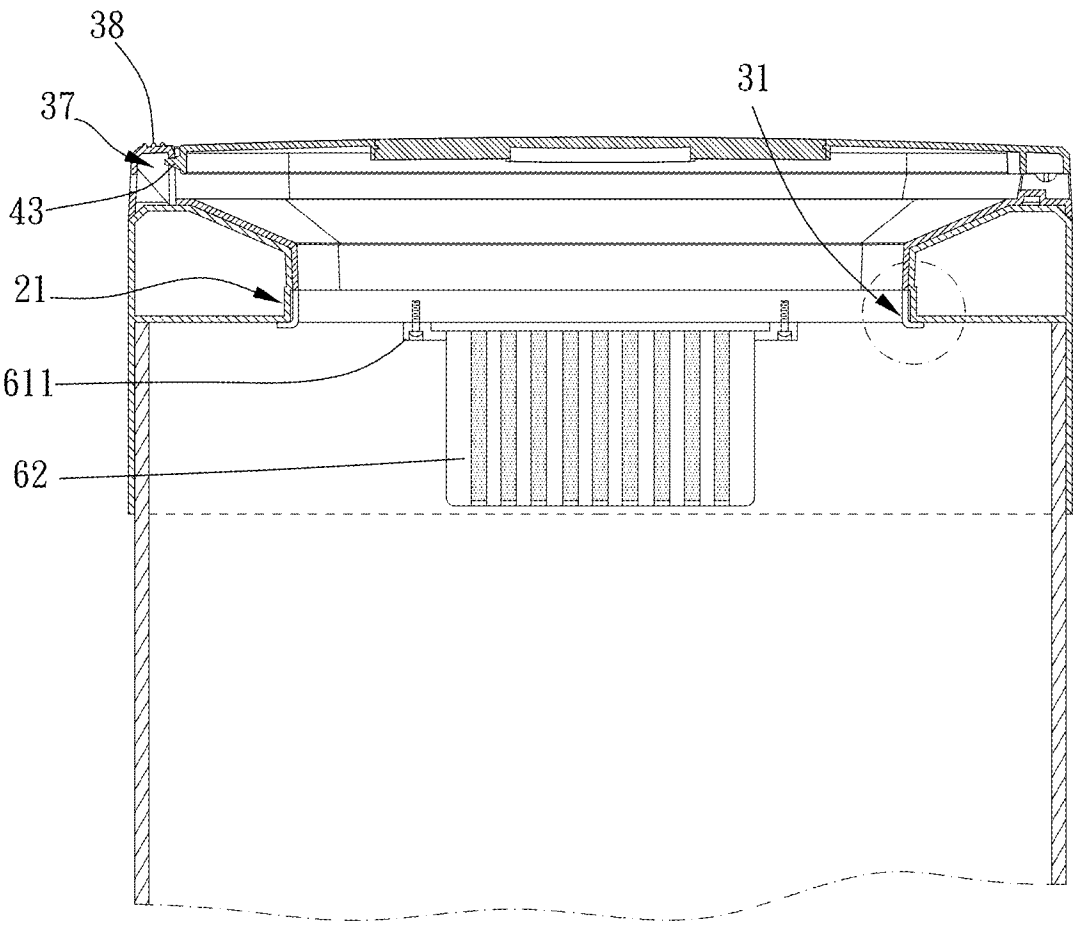
FIG. 4 is a lateral cross-section of the present invention.
Figure 6:
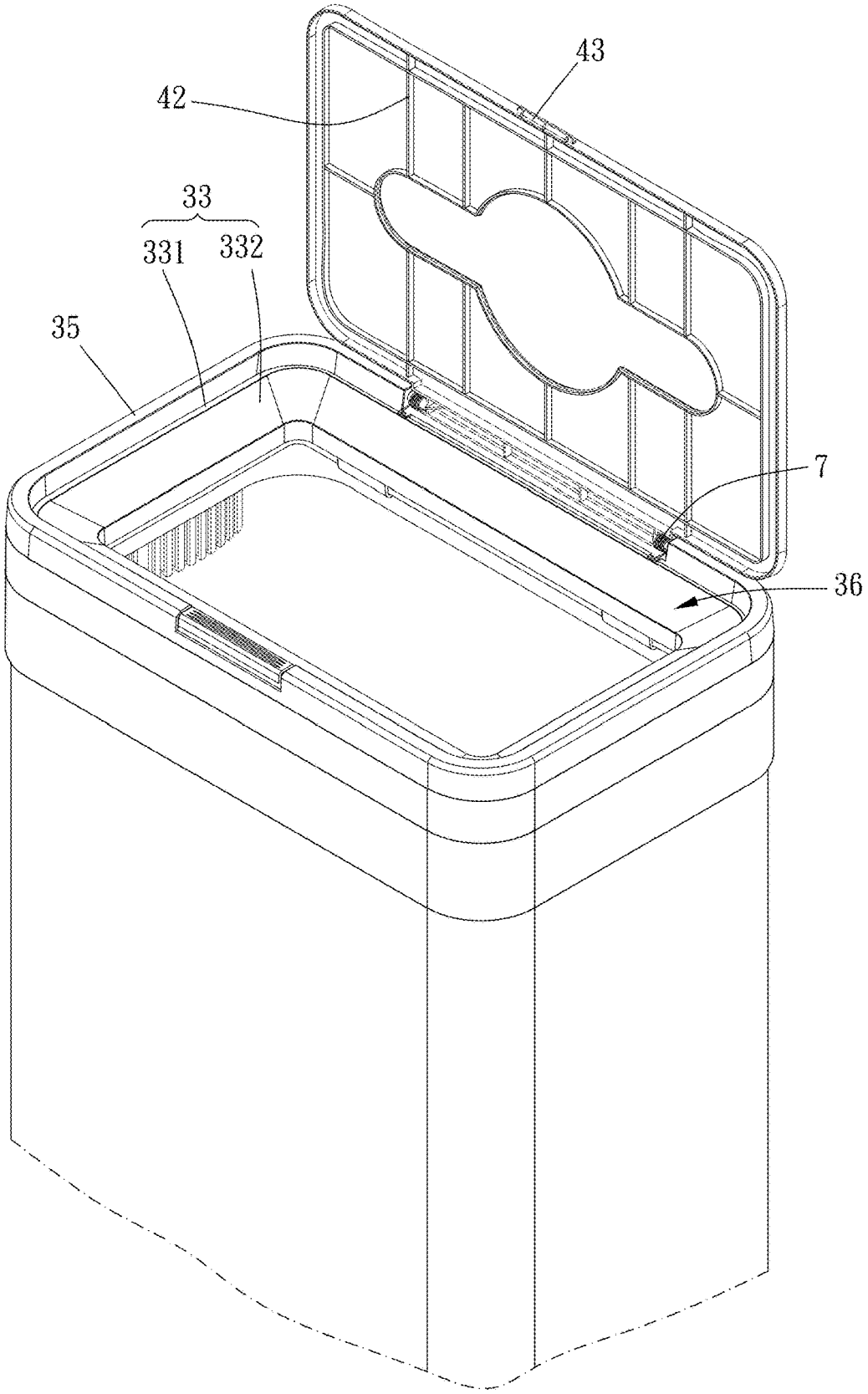
FIG. 6 is an illustration showing that a lid of the present invention is opened.
Figure 7:
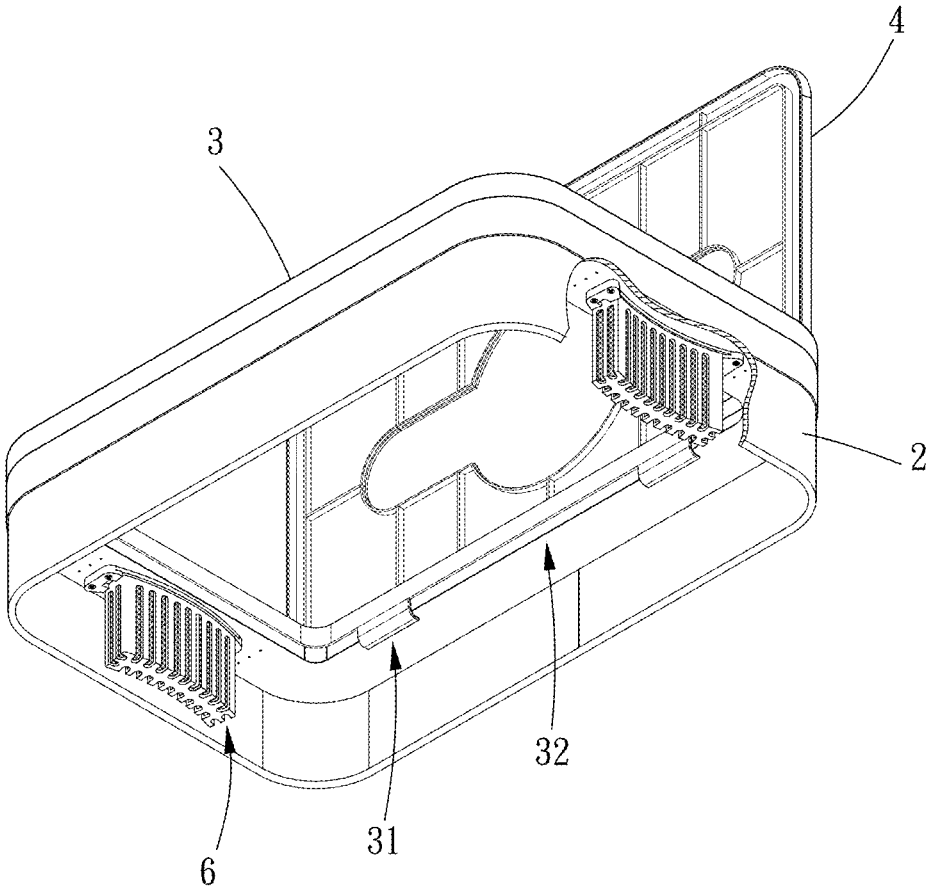
FIG. 7 is a stereogram of the present invention without a bin body.
Figure 8:
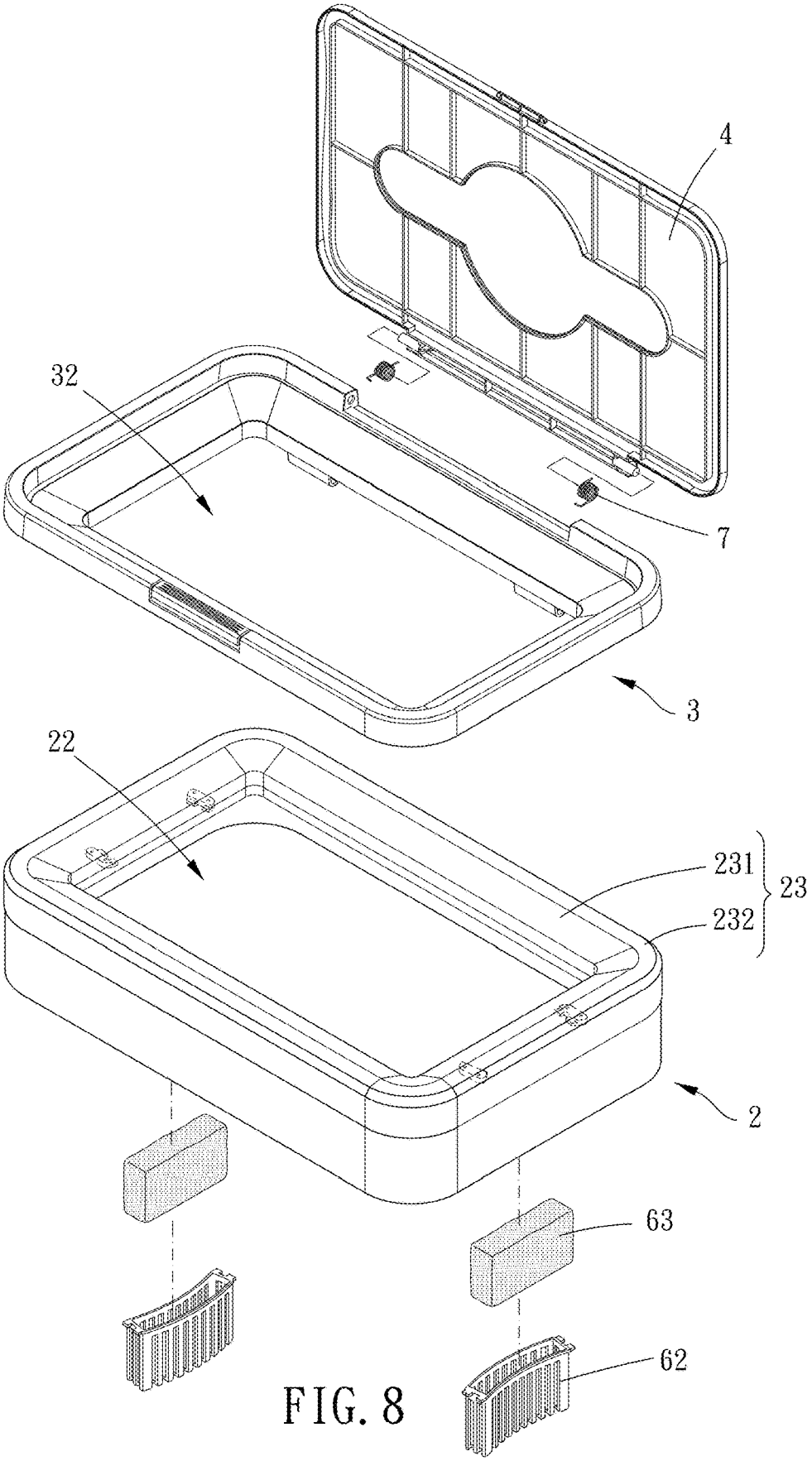
FIG. 8 is a breakdown drawing of the present invention without a bin body.
Figure 9:
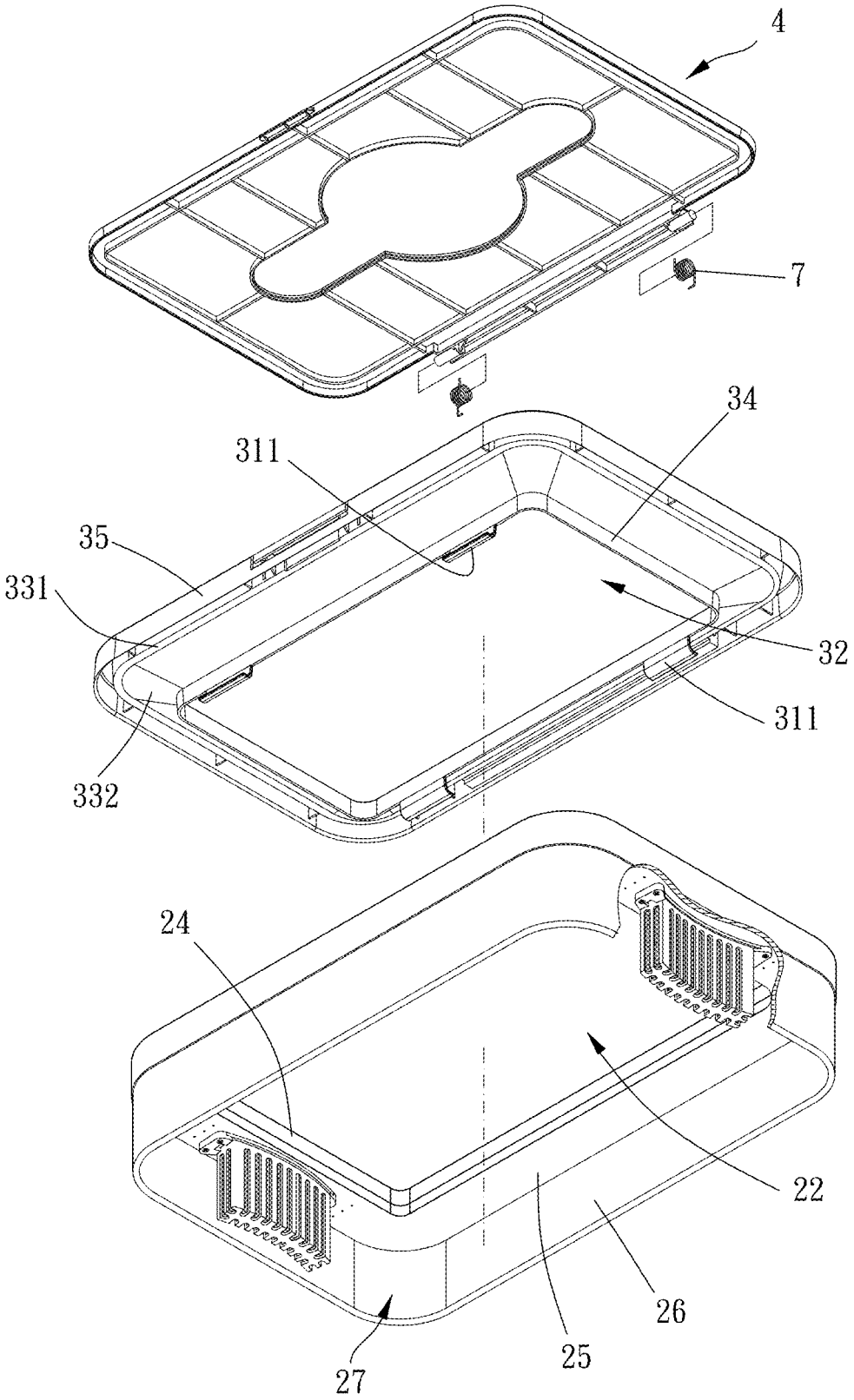
FIG. 9 is a breakdown drawing of the present invention without a bin body at an other angle.
Figure 10:
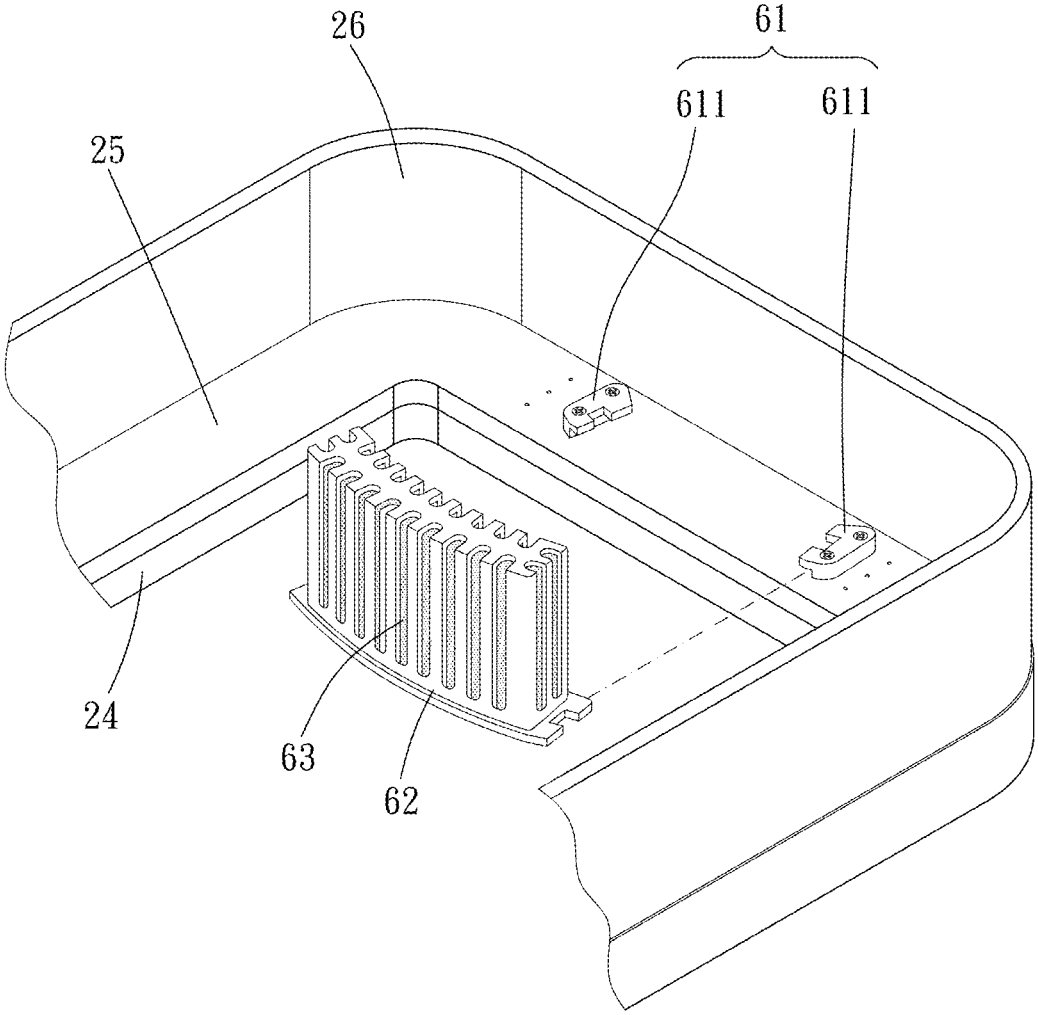
FIG. 10 is a breakdown drawing showing a suspension unit of the present invention.
Figure 11:
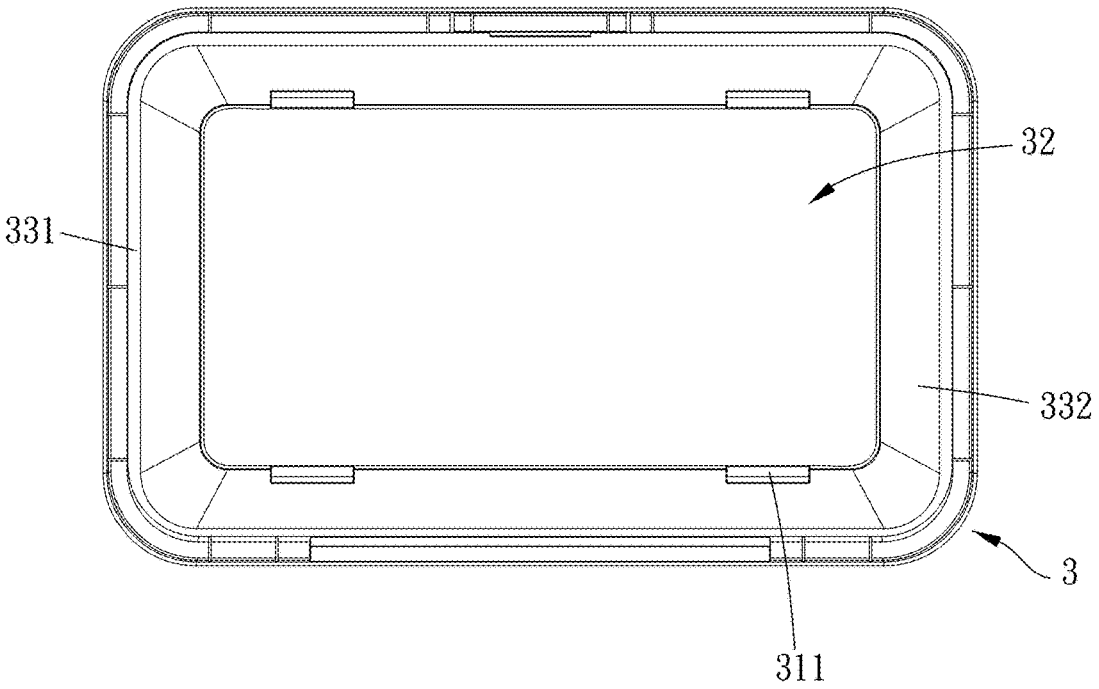
FIG. 11 is a bottom view showing a second frame of the present invention.
Figure 12:
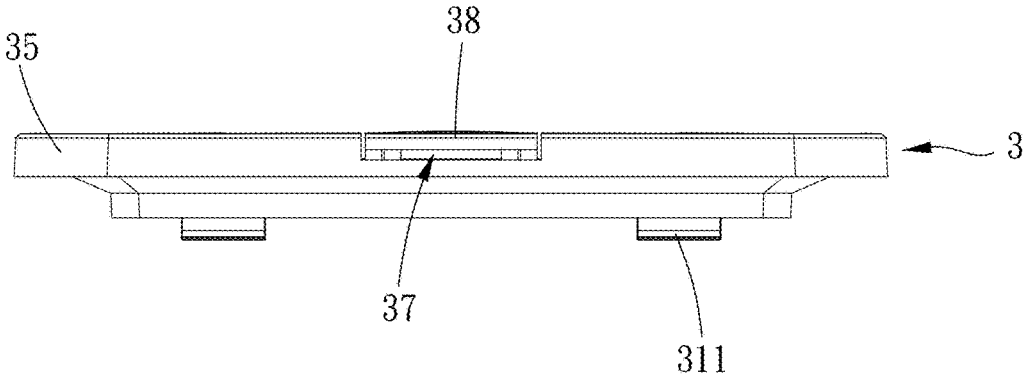
FIG. 12 is a lateral view showing a second frame of the present invention.
Figure 13:
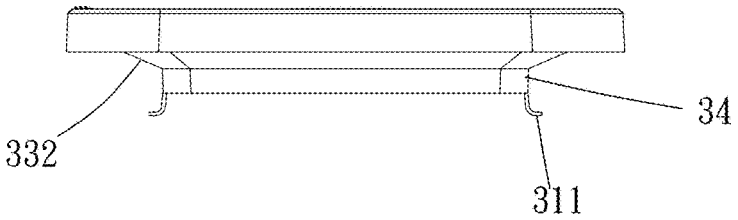
FIG. 13 is a lateral view showing a second frame of the present invention at an other angle.

Please refer to FIG. 1 to FIG. 13, the garbage bin of the present invention includes a bin body 1, a first frame 2, a second frame 3, and a lid body 4.

The bin body 1 has an opening 11 and an internal space 12. The first frame 2 is disposed on the bin body 1 and includes a first engaging unit 21. The first frame 2 encloses a first opening 22. The first opening 22 communicates the opening 11 of the bin body 1. A direction along which the first opening 22 is formed is the same with a direction along which the opening 11 of the bin body 1 is formed. The second frame 2 includes a second engaging unit 31 and encloses a second opening 32. The second frame 2 is detachably connected to the first frame 2 by an engagement of the first engaging unit 21 and the second engaging unit 31. The second opening 32 communicates the first opening 22. A direction along which the second opening 32 is formed is the same with the direction along which the opening 11 of the bin body 1 is formed. The lid body 4 is pivotally connected to the second frame 3 to selectively cover at least part of the second opening 32. Preferably, a plurality of reinforcement ribs 42 are disposed on the lid body 42 to enhance the structure strength.

By removing the second frame 3 or not, the garbage bin can be changed between lid-type and open-type. No matter the garbage bin is lid-type or open-type, the fringe of the opening 11 of the bin body 1 is covered by the first frame 2 for protection from damaging or hurting the users. Besides, garbage bag can be clamped by the first frame 2 and the bin body 1 to prevent the garbage bag from falling.

In the present embodiment, the bin body 1 is made of metal to have a stronger structure, and the lid body 4, the first frame 2, and the second frame 3 can be made of plastic to have a better elasticity and to be easy to manufacture.

Specifically, the lid body 4 has a positioning portion 43 extending therefrom, and the second frame 3 has an insertion opening 37 and a blocking portion 38. The blocking portion 38 is movably arranged beside the insertion opening 37. When the positioning portion 43 is inserted into the insertion opening 37, the blocking portion 38 is located above the positioning portion 43 so that the lid body 4 is prohibited from pivoting in order to cover the second opening 32. Thereby, the lid body 4 is prevented from being opened accidentally. When the blocking portion 38 is moved away from the positioning portion 43, the lid body 4 is pivotable. In the present embodiment, at least one elastic member 7 is biased between the lid body 4 and the second frame 3 so that the lid body 4 tends to move away from the second opening 32 normally. Thus, when the blocking portion 38 is pressed to leave the positioning portion 43, the lid body 4 opens automatically for receiving garbage.

More specifically, the lid body 4 is formed with an inlet opening 41. A direction along which the inlet opening 41 is formed is the same with the direction along which the opening 11 of the bin body 1 is formed. The inlet opening 41 has an area smaller than half an area of the second opening 32. A covering plate 5 is removably engaged with the lid body 4 to be embedded in the inlet opening 41 in order to cover the inlet opening 41. When the covering plate 5 is removed, the inlet opening 41 becomes open all the time. Thus, small garbage can be thrown into the garbage bin via the inlet opening 41 without opening the lid body 4. Besides, the small inlet opening 41 can prevent pets from reaching the garbage inside the garbage bin, and the garbage in the internal space 12 may not be brought out by wind.

Preferably, the color of the lid body 4 is the same with the color of the second frame 3, and the color of the second frame 3 is different from the color of the first frame 2. For example, the second frame 3 can be blue, green, yellow, or red for sorting recycled garbage. For instance, blue means recycled paper, green means recycled glass, yellow means recycled metal, and red means recycled plastics. The color of the second frame can be chosen by the user according to the colors of the surroundings.

In detail, the second engaging unit 31 includes a plurality of hook members 311 for hooking on the first engaging unit 21 so that the second frame 3 is engaged with the first frame 2. The structure of hooks is advantageous at quick detachment and quick engagement. In the present embodiment, the hook members 311 include four said hook members 311 symmetrically arranged on the second frame 3 to steadily connect to the first frame 2.

The first frame 2 includes a first top portion 23 and a first surrounding portion 24. The first top portion 23 is connected to the first surrounding portion 24 and is nonparallel to the first surrounding portion 24. The first top portion 23 is adapted for supporting the second frame 4. The first surrounding portion 24 surrounds the first opening 22. The plurality of hook members 311 are inserted through the first opening 22 and then hook on the first surrounding portion 24 laterally. Because the hook members 311 are inserted through the existed first opening 22, the first frame 2 doesn't have to form any through hole. In addition, the hook members 311 are protected by the first frame 2 from colliding.

The second frame 3 includes a second top portion 33 and a second surrounding portion 34. The second top portion 33 is connected to the second surrounding portion 34 and is nonparallel to the second surrounding portion 34. The second surrounding portion 34 surrounds the second opening 32. The hook members 311 are disposed on the second surrounding portion 34. When the second frame 3 is engaged with the first frame 2, the second top portion 33 abuts against the first stop portion 23, and the second surrounding portion 34 is inserted into the first opening 22 so that the second surrounding portion 34 and the first surrounding portion 24 restrict each other along a direction perpendicular to the direction along which the opening 11 of the bin body 1 is formed. Thereby, when collided by other objects, the second frame 3 can be prevented from deviating from the first frame 2 due to the first surrounding portion 24.

In the present embodiment, the second surrounding portion 34 and the first surrounding portion 24 abuts against each other laterally so that the first surrounding portion 24 can restrict the second surrounding portion 34 well to make the first frame 2 firmly connect to the second frame 3. Along the direction along which the opening 11 of the bin body 1 is formed, a length of the second surrounding portion 34 is equal to or larger than half a length of the first surrounding portion 24. Thus, larger contact area between the first surrounding portion 24 and the second surrounding portion 34 provides sufficient support to the second surrounding portion 34.

The bin body 1 defines a central axis 13. The first top portion 23 includes a first inclined section 231. The first inclined section 231 faces the opening 11 of the bin body 1 and extends toward the central axis 13. The second top portion 33 includes a second inclined section 332. The second inclined section 332 faces the opening 11 of the bin body 1 and extends toward the central axis 13. Thus, the garbage can be guided into the internal space 12 by the first inclined section 231 and the second inclined section 332. When the second frame 3 is engaged with the first frame 2, the second inclined section 332 abuts against the first inclined section 231. In the present embodiment, when the second frame 3 is engaged with the first frame 2, the second inclined section 332 completely covers the first inclined section 231 to prevent dust from accumulating therebetween. Besides, an angle between the first inclined section 231 and the central axis 13 is 60-70 degrees so as to make the garbage slide.

The first top portion 23 further includes a first flat section 232. The first flat section 232 is connected to an end of the first inclined section 231 remote from the opening 11 of the bin body 1. The second top portion 33 further includes a second flat section 331. The second flat section 331 is connected to an end of the second inclined section 332 remote from the opening 11 of the bin body 1. The first flat section 232 and the second flat section 331 are perpendicular to the central axis 13 respectively. The second flat section 331 abuts against the first flat section 232 when the second frame 3 is engaged with the first frame 2. Thereby, the contact area between the first frame 2 and the second frame 3 is increased, and the force along the central axis 13 can be resisted.

Specifically, each of the hook members 331 extends from the second surrounding portion 34 integrally to make it easier to assemble. Preferably, along the direction perpendicular to the central axis 13, a portion of the first surrounding portion 24 not abutting against the second surrounding portion 34 is remoter from the central axis 13 than other portions of the first surrounding portion 24. Thus, the hook members 331 can have more space to deform or to have a larger thickness. Besides, along a direction of the central axis 13, a length of each of the hook members 331 is 0.8-1.0 times a length of the second surrounding portion 34. Thus, the areas of hooking can be distributed evenly.

The first frame 2 further includes a first bottom portion 25 and a first flange 26. The first bottom portion 25 is connected to the first surrounding portion 24 and is nonparallel to the first surrounding portion 24. The hook members 331 are inserted through the first opening 22 and then hook onto a part of the first bottom portion 25. In the present embodiment, the first engaging unit 21 includes a part of the first surrounding portion 24 and the part of the first bottom portion 25. Specifically, the first flange 26 extends horizontally from the first bottom portion 25. The first flange 26 and the first bottom portion 25 form a sleeving portion 27 for being sleeved onto the bin body 1. The first bottom portion 25 abuts against a terminal end of the bin body 1 to make the first frame 2 firmly connect to the bin body 1. More specifically, the second frame 3 further has a second flange 35. The second flange 35 extends from the second top portion 33. The second flange 35 and the second top portion 33 form a receiving portion 36. The lid body 4 is pivotally connected to the second flange 35. The lid body 4 is received in the receiving portion 36 when the lid body 4 covers at least a part of the second opening 32. Thus, the lid body 4 is prevented from collision.

The garbage bin further includes at least one suspension unit 6. The at least one suspension unit 6 includes a positioning assembly 61 and a suspension member 62. The positioning assembly 61 is disposed on a side of the first frame 2 opposite to the second frame 3. The suspension member 6 is detachably engaged with the positioning assembly 61 to be hung in the internal space 12. The suspension member 62 is adapted for connecting to a deodorant unit 63 to eliminate the odor in the internal space 12.

In the present embodiment, the positioning assembly 61 and the first flange 26 are arranged spacedly, and an end of the bin body 1 is located between the positioning assembly 61 and the first flange 26. Specifically, the positioning assembly 61 includes two positioning sliding rails 611 detachably screwed with the first bottom portion 25. Thus, the suspension member 62 can be replaced by others in different sizes. The suspension member 62 is detachably and slidably arranged on the two sliding rails 611 to make it easy to replace the deodorant unit 63.

In conclusion, the lid body is pivotally connected to the second frame, and the second frame is detachably connected to the first frame. In addition, the lid body is formed with the inlet opening, and the inlet opening is selectively covered by the covering plate. Thereby, the structure of the garbage bin can be changed to meet the needs of users. That is, the first frame and the bin body can be used at any mode, and the lid body and the second frame can be changed or removed if needed.

What is claimed is:

1. A garbage bin, including:

a bin body, having an opening and an internal space;

a first frame, disposed on the bin body, including a first engaging unit and enclosing a first opening, the first opening communicating the opening of the bin body, a direction along which the first opening is formed being the same with a direction along which the opening of the bin body is formed;

a second frame, including a second engaging unit and enclosing a second opening, the second frame being detachably connected to the first frame by an engagement of the first engaging unit and the second engaging unit, the second opening communicating the first opening, a direction along which the second opening is formed being the same with the direction along which the opening of the bin body is formed;

a lid body, pivotally connected to the second frame to selectively cover at least part of the second opening;

wherein the second engaging unit includes a plurality of hook members for hooking on the first engaging unit so that the second frame is engaged with the first frame.

2. The garbage bin of claim 1, wherein the first frame includes a first top portion and a first surrounding portion, the first top portion is connected to the first surrounding portion and is nonparallel to the first surrounding portion, the first top portion is adapted for supporting the second frame, the first surrounding portion surrounds the first opening, the plurality of hook members are inserted through the first opening and then hook on the first surrounding portion laterally.

3. The garbage bin of claim 2, wherein the second frame includes a second top portion and a second surrounding portion, the second top portion is connected to the second surrounding portion and is nonparallel to the second surrounding portion, the second surrounding portion surrounds the second opening, the hook members are disposed on the second surrounding portion; when the second frame is engaged with the first frame, the second top portion abuts against the first stop portion, the second surrounding portion is inserted into the first opening so that the second surrounding portion and the first surrounding portion restrict each other along a direction perpendicular to the direction along which the opening of the bin body is formed.

4. The garbage bin of claim 3, wherein the bin body defines a central axis, the first top portion includes a first inclined section, the first inclined section faces the opening of the bin body and extends toward the central axis, the second top portion includes a second inclined section, the second inclined section faces the opening of the bin body and extends toward the central axis; when the second frame is engaged with the first frame, the second inclined section abuts against the first inclined section.

5. The garbage bin of claim 4, wherein each of the hook member extends from the second surrounding portion integrally, the second surrounding portion and the first surrounding portion abuts against each other laterally; along the direction along which the opening of the bin body is formed, a length of the second surrounding portion is equal to or larger than half a length of the first surrounding portion; the lid body is formed with an inlet opening, a direction along which the inlet opening is formed is the same with the direction along which the opening of the bin body is formed, the inlet opening has an area smaller than half an area of the second opening, a covering plate is removably engaged with the lid body to be embedded in the inlet opening in order to cover the inlet opening; the garbage bin further includes two suspension units, each of the suspension units includes a positioning assembly and a suspension member, the positioning assembly is disposed on a side of the first frame opposite to the second frame, the suspension member is detachably engaged with the positioning assembly to be hung in the internal space, the suspension member is adapted for connecting to an deodorant unit; a color of the bin body is the same with a color of the second frame, the color of the second frame is different from a color of the first frame; the first frame includes a first bottom portion and a first flange, the first bottom portion is connected to the first surrounding portion and is nonparallel to the first surrounding portion, the hook members are inserted through the first opening and then hook onto a part of the first bottom portion, the first engaging unit includes a part of the first surrounding portion and the part of the first bottom portion, the first flange extends horizontally from the first bottom portion, the first flange and the first bottom portion form a sleeving portion for being sleeved onto the bin body, the first bottom portion abuts against a terminal end of the bin body; the positioning assembly and the first flange are arranged spacedly, an end of the bin body is located between the positioning assembly and the first flange; the positioning assembly includes two sliding rails detachably screwed with the first bottom portion, the suspension member is detachably and slidably disposed on the two sliding rails; along a direction of the central axis, a length of each of the hook members is 0.8-1.0 times a length of the second surrounding portion; an angle between the first inclined section and the central axis is 60-70 degrees; the hook members includes four said hook members, the four hook members are symmetrically arranged on the second frame; the first top portion further includes a first flat section, the first flat section is connected to an end of the first inclined section remote from the opening of the bin body, the second top portion further includes a second flat section, the second flat section is connected to an end of the second inclined section remote from the opening of the bin body, the first flat section and the second flat section are perpendicular to the central axis respectively, the second flat section abuts against the first flat section when the second frame is engaged with the first frame; the second frame further has a second flange, the second flange extends from the second top portion, the second flange and the second top portion form a receiving portion, the lid body is pivotally connected to the second flange, the lid body is received in the receiving portion when the lid body covers at least a part of the second opening; a plurality of reinforcement ribs are disposed on the lid body; the lid body has a positioning portion extending therefrom, the second frame has an insertion opening and a blocking portion, the blocking portion is movably arranged beside the insertion opening; when the positioning portion is inserted into the insertion opening, the blocking portion is located above the positioning portion so that the lid body is prohibited from pivoting in order to cover the second opening; when the blocking portion is moved away from the positioning portion, the lid body is pivotable; at least one elastic member is biased between the lid body and the second frame so that the lid body tends to move away from the second opening normally; the first inclined section is completely covered by the second inclined section; along the direction perpendicular to the central axis, a portion of the first surrounding portion not abutting against the second surrounding portion is remoter from the central axis than other portions of the first surrounding portion; each of the lid body, the first frame, and the second frame is made of plastic, the bin body is made of metal; a color of the second frame is selected from a group composed of blue, green, yellow, and red.

6. The garbage bin of claim 3, wherein each of the hook members extends from the second surrounding portion integrally, the second surrounding portion and the first surrounding portion abuts against each other laterally; along the direction along which the opening of the bin body is formed, a length of the second surrounding portion is equal to or larger than half a length of the first surrounding portion.

7. The garbage bin of claim 1, wherein a color of the bin body is the same with a color of the second frame, the color of the second frame is different from a color of the first frame.

8. A garbage bin, including:

a bin body, having an opening and an internal space;

a first frame, disposed on the bin body, including a first engaging unit and enclosing a first opening, the first opening communicating the opening of the bin body, a direction along which the first opening is formed being the same with a direction along which the opening of the bin body is formed;

a second frame, including a second engaging unit and enclosing a second opening, the second frame being detachably connected to the first frame by an engagement of the first engaging unit and the second engaging unit, the second opening communicating the first opening, a direction along which the second opening is formed being the same with the direction along which the opening of the bin body is formed;

a lid body, pivotally connected to the second frame to selectively cover at least part of the second opening;

wherein the lid body is formed with an inlet opening, a direction along which the inlet opening is formed is the same with the direction along which the opening of the bin body is formed, the inlet opening has an area smaller than half an area of the second opening, a covering plate is removably engaged with the lid body to be embedded in the inlet opening in order to cover the inlet opening.

9. A garbage bin, including:

a bin body, having an opening and an internal space;

a first frame, disposed on the bin body, including a first engaging unit and enclosing a first opening, the first opening communicating the opening of the bin body, a direction along which the first opening is formed being the same with a direction along which the opening of the bin body is formed;

a second frame, including a second engaging unit and enclosing a second opening, the second frame being detachably connected to the first frame by an engagement of the first engaging unit and the second engaging unit, the second opening communicating the first opening, a direction along which the second opening is formed being the same with the direction along which the opening of the bin body is formed;

a lid body, pivotally connected to the second frame to selectively cover at least part of the second opening;

at least one suspension unit, the at least one suspension unit including a positioning assembly and a suspension member, the positioning assembly being disposed on a side of the first frame opposite to the second frame, the suspension member being detachably engaged with the positioning assembly to be hung in the internal space, the suspension member being adapted for connecting to a deodorant unit.

* * * * *